US009995485B2

(12) United States Patent
Kosol et al.

(10) Patent No.: US 9,995,485 B2
(45) Date of Patent: Jun. 12, 2018

(54) ARTICULATING HOLD DOWN MECHANISM FOR A FURNACE

(71) Applicant: ATI PROPERTIES LLC, Albany, OR (US)

(72) Inventors: Edward A. Kosol, Bridgeville, PA (US); Joseph F. Perez, Elizabeth, PA (US)

(73) Assignee: ATI PROPERTIES LLC, Albany, OR (US)

( * ) Notice: Subject to any disclaimer, the term of this patent is extended or adjusted under 35 U.S.C. 154(b) by 22 days.

(21) Appl. No.: 15/163,879

(22) Filed: May 25, 2016

(65) Prior Publication Data

US 2016/0265770 A1 Sep. 15, 2016

Related U.S. Application Data

(63) Continuation of application No. 14/739,525, filed on Jun. 15, 2015, now Pat. No. 9,377,241, which is a continuation of application No. 13/482,089, filed on May 29, 2012, now Pat. No. 9,086,240.

(51) Int. Cl.

| | |
|---|---|
| ***F23M 5/00*** | (2006.01) |
| ***F23M 5/04*** | (2006.01) |
| ***F27B 14/06*** | (2006.01) |
| ***F27B 14/08*** | (2006.01) |
| ***F27D 1/14*** | (2006.01) |

(Continued)

(52) U.S. Cl.

CPC ..... *F23M 5/04* (2013.01); *F27B 14/061* (2013.01); *F27B 14/08* (2013.01); *F27D 1/144* (2013.01); *F27D 1/145* (2013.01); *F27D 1/1621* (2013.01); *F27B 2014/104* (2013.01); *Y10T 29/49826* (2015.01)

(58) Field of Classification Search

CPC ..... F27B 14/061
USPC ..... 266/283; 373/153
See application file for complete search history.

(56) References Cited

U.S. PATENT DOCUMENTS

| | | | |
|---|---|---|---|
| 1,129,983 | A | 3/1915 | Iler |
| 2,229,359 | A | 1/1941 | York |
| 2,451,679 | A | 10/1948 | Komorowski |

(Continued)

FOREIGN PATENT DOCUMENTS

| | | |
|---|---|---|
| GB | 893862 | 4/1962 |
| GB | 962989 | 7/1964 |
| GB | 2339888 A | 2/2000 |

*Primary Examiner* — Scott R Kastler
(74) *Attorney, Agent, or Firm* — K&L Gates LLP

(57) ABSTRACT

A hold down mechanism for releasably securing a refractory lining to a furnace. The hold down mechanism can comprise plate segments that form a composite plate. The plate segments can comprise a first plate segment structured to articulate relative to a second plate segment. Furthermore, a gap in the hold down mechanism can be structured to adjust in response to a thermal condition of the composite plate, such as thermal expansion or thermal contraction of at least one plate segment. The composite plate can also comprise an articulation plate pivotally coupled to at least one of the first plate segment and the second plate segment via a pivot and/or a slot and pin engagement. The composite plate can further comprise a third plate segment and a second articulation plate pivotally coupled to at least one of the second plate segment and the third plate segment.

15 Claims, 7 Drawing Sheets

(51) Int. Cl.
*F27D 1/16* (2006.01)
*F27B 14/10* (2006.01)

(56) References Cited

U.S. PATENT DOCUMENTS

| | | | | |
|---|---|---|---|---|
| 3,053,237 | A | 9/1962 | Carter | |
| 3,393,836 | A | 7/1968 | Greenewald, Jr. | |
| 3,771,467 | A | 11/1973 | Sweet | |
| 3,984,613 | A | 10/1976 | Reese | |
| 4,055,336 | A | 10/1977 | Massin | |
| 5,101,608 | A | 4/1992 | Ewers | |
| 5,259,758 | A | 11/1993 | Lauersdorf | |
| 5,671,799 | A | 9/1997 | Merrill | |
| 6,743,382 | B2 | 6/2004 | Opatt et al. | |
| 6,768,766 | B1 * | 7/2004 | Green | F27B 14/061 373/153 |
| 9,086,240 | B2 * | 7/2015 | Kosol | F27B 14/061 |
| 9,377,241 | B2 * | 6/2016 | Kosol | F27B 14/061 |
| 2011/0048315 | A1 | 3/2011 | Kemmochi et al. | |
| 2015/0285556 | A1 | 10/2015 | Kosol et al. | |

* cited by examiner

ARTICULATING HOLD DOWN MECHANISM FOR A FURNACE

CROSS-REFERENCE TO RELATED APPLICATIONS

This patent application is a continuation application claiming priority under 35 U.S.C. § 120 to U.S. application Ser. No. 14/739,525, filed on Jun. 15, 2015, now issued as U.S. Pat. No. 9,377,241, which in turn is a continuation application claiming priority under 35 U.S.C. § 120 to U.S. application Ser. No. 13/482,089, filed on May 29, 2012, now issued as U.S. Pat. No. 9,086,240. The application and issued patent are hereby incorporated herein by reference in their entireties.

FIELD OF TECHNOLOGY

The present disclosure relates to a hold down mechanism for releasably securing a lining to a furnace. The present disclosure further relates to a method of relining a furnace.

BACKGROUND OF THE INVENTION

A hold down mechanism can be used with a variety of furnace types including, for example, induction furnaces. To summarize, an induction furnace can melt an alloy charge placed within a crucible of the furnace by applying a primary electric current to electrically conductive furnace coils that surround the crucible. The primary current induces a secondary current within the charge; this secondary current meets electrical resistance in the charge, which generates heat. When sufficient heat is generated, the alloy charge melts. In operation, an induction furnace can reach temperatures that range from approximately 1000° F. to approximately 3300° F.

A heat-resistant, refractory lining is often positioned in the crucible of the furnace to hold the molten charge and the hot gases. The lining can be secured to an interior surface of the crucible, for example. Refractory linings used in induction furnaces are usually composed of oxides of materials such as, for example, silica ($SiO_2$), alumina ($Al_2O_3$), and/or magnesia (MgO). The appropriate refractory material for a particular furnace depends on the metallurgical requirements, operating temperatures, and type of melting operations. Due to the high temperatures within the furnace, the refractory lining is often a consumable material that erodes or becomes otherwise damaged over time. When the lining has been consumed and/or damaged to a particular extent, the refractory lining is replaced. An induction furnace in an industrial facility may be relined several times per year, for example.

A hold down mechanism is often used to secure a refractory lining to an induction furnace. When the crucible of the furnace is tilted to empty the crucible contents, i.e., the molten alloy charge, the hold down mechanism can retain the refractory lining in the crucible, for example. The hold down mechanism can be releasably secured to the furnace by fasteners. For example, bolts can secure the hold down mechanism to the body of the furnace. As the furnace generates heat, the hold down mechanism can be subjected to extremely high temperatures, which can cause thermal expansion of the hold down mechanism or parts thereof. The thermal expansion can, in turn, cause the hold down mechanism to buckle and/or warp between fasteners. Once warped to a certain degree, the hold down mechanism no longer operates properly and should be replaced with a new or rebuilt hold down mechanism. The hold down mechanism is often replaced each time the furnace is relined; for example, the hold down mechanism can be replaced four times per year on a furnace that is relined four times per year. Replacement of the hold down mechanism can significantly add to the maintenance costs of the furnace. A new hold down plate for an induction furnace in an industrial facility may cost approximately $5,000 or more, for example. Thus, if a furnace is relined four times per year, replacement of the hold down mechanism can add $20,000 or more to yearly furnace maintenance costs.

Hold down mechanisms can comprise reinforcing features intended to prevent or limit warping of the hold down mechanism in the region between fasteners. The reinforcing features can include arms, ribs and/or shoulders, for example, on the hold down mechanism. Even if reinforcing features are provided, warping of the hold down mechanism can still occur, especially at higher temperatures. For example, warping of hold down mechanisms including reinforcing features has been observed at operating temperatures above approximately 2000° F.

In an effort to reduce maintenance expenses, warped hold down mechanisms may be rebuilt and reinstalled. Rebuilding a warped hold down mechanism can afford cost savings over complete replacement of the hold down mechanism. However, rebuilding a hold down mechanism can be difficult and may still be expensive. Furthermore, a hold down mechanism can be warped to such a degree that rebuilding the mechanism is impractical.

Accordingly, it would be advantageous to provide a hold down mechanism that is less susceptible to warping from the high temperatures common to operation of an induction furnace. Further, it would be advantageous to provide a hold down mechanism that can be reinstalled and reused when the furnace is relined. More generally, it would be advantageous to provide an improved hold down mechanism for releasably holding a refractory lining relative to a furnace.

SUMMARY OF THE PRESENT INVENTION

An aspect of the present disclosure is directed to an apparatus for releasably holding a lining relative to a furnace. The apparatus can comprise a gap and a plurality of (i.e., two or more) plate segments that form a composite plate. The plurality of plate segments can comprise a first plate segment structured to articulate relative to a second plate segment. Furthermore, the gap can be structured to adjust in response to a temperature or other thermal condition of at least one plate segment of the plurality of plates. The plurality of plate segments can also comprise an articulation plate pivotally coupled to at least one of the first plate segment and the second plate segment via a slot and pin engagement. The plurality of plate segments can further comprise a third plate segment and a second articulation plate pivotally coupled to at least one of the second plate segment and the third plate segment. Further, each plate segment can comprise a curvature and may have a plurality of reinforcing ribs. The curvature of each of the plate segments can substantially match or may differ among plates.

Another aspect of the present disclosure is directed to a hold down or restraining plate for releasably securing a lining to a furnace. The restraining plate can comprise a first segment, a second segment positioned relative to the first segment, a first articulation plate positioned between the first segment and the second segment and pivotally connected to the first segment, and a variable gap that adjusts when the articulation plate pivots. The variable gap can adjust when the articulation pivots to accommodate thermal expansion or contraction of the first segment and/or the second segment. Further, the first segment can be positioned relative to the second segment to form an arc.

Yet another aspect of the present disclosure is directed to a furnace comprising a crucible, a lining positioned at least partially within the crucible, and a hold down plate releasably engageable with the crucible. The hold down plate can hold the lining relative to the crucible when the hold down plate is engaged with the furnace. Furthermore, the hold down plate can comprise a composite plate comprising a plurality of segments, including a first segment structured to articulate relative to a second segment. The hold down plate can also comprise a gap comprising a variable width that adjusts in response to a temperature or other thermal condition of at least one segment of the hold down plate. The furnace can be an induction furnace. Further, fasteners can releasably secure the hold down plate to the furnace, and the hold down plate can abut a rim of a refractory lining of the furnace when the fasteners secure the hold down plate to the furnace. The furnace can also comprise a spout structured to fit in the gap of the hold down plate.

Still another aspect of the present disclosure is directed to a method of relining a furnace comprising the steps of disengaging a hold down plate from the furnace, removing a first lining from a crucible of the furnace, positioning a second lining at least partially within the crucible of the furnace, and reengaging the hold down plate with the furnace to releasably secure the second lining to the crucible. The reengaging step can further comprise bolting the hold down plate to the furnace and/or positioning a spout in the variable gap of the hold down plate.

The reader will appreciate the foregoing details and advantages of the present invention, as well as others, upon considering the following detailed description of certain non-limiting embodiments of the invention. The reader also may comprehend such additional details and advantages of the present invention upon making and/or using embodiments within the present invention.

BRIEF DESCRIPTION OF THE FIGURES

The features and advantages of the present invention may be better understood by reference to the accompanying figures in which.

DESCRIPTION OF NON-LIMITING EMBODIMENTS OF THE INVENTION

Figure 1:
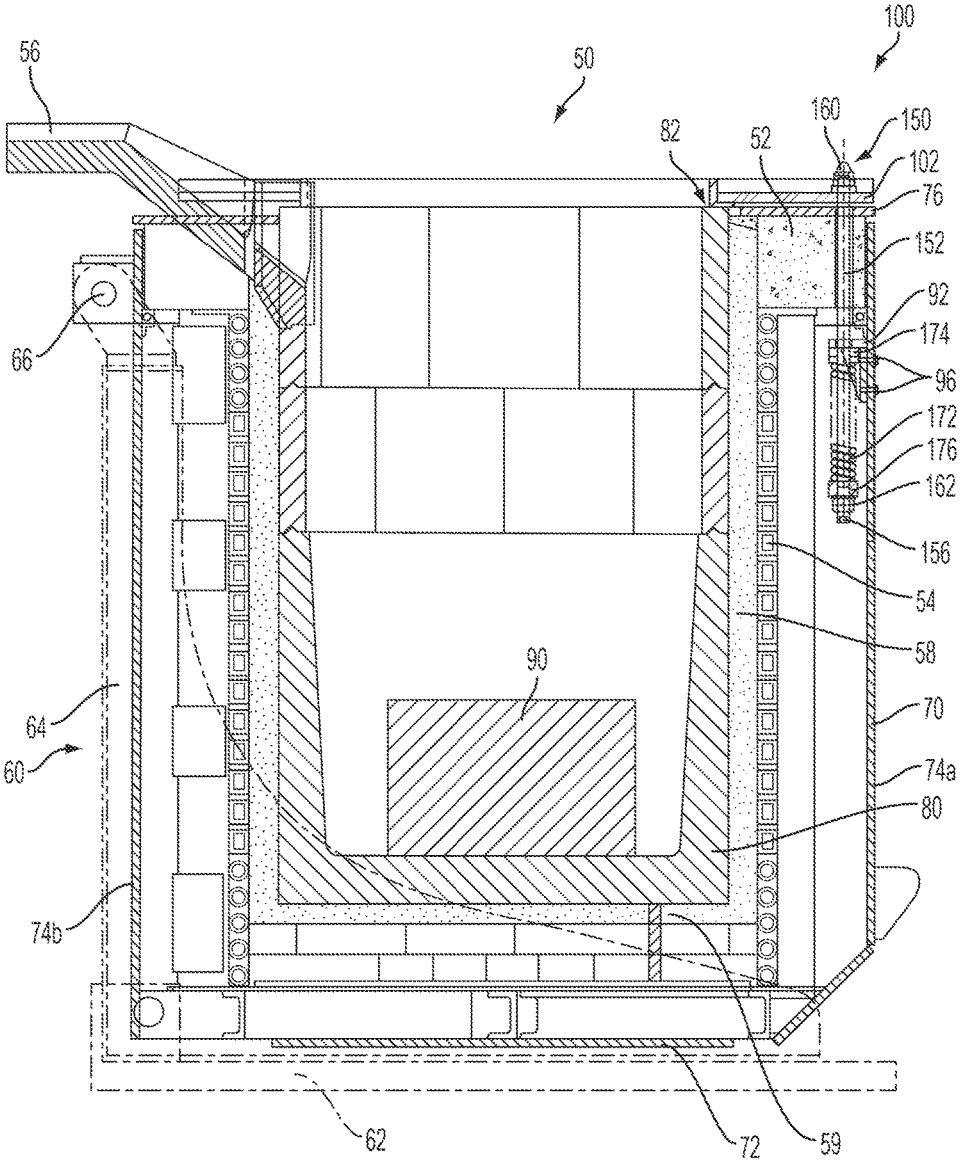
FIG. 1 is cross-sectional, elevational view of an induction furnace and a hold down mechanism and also illustrating a lift assembly in phantom lines according to at least one non-limiting embodiment of the present disclosure.

Various embodiments are described and illustrated in this specification to provide an overall understanding of the elements, steps, and use of the disclosed device and methods. It is understood that the various embodiments described and illustrated in this specification are non-limiting and non-exhaustive. Thus, the invention is not limited by the description of the various non-limiting and non-exhaustive embodiments disclosed in this specification. In appropriate circumstances, the features and characteristics described in connection with various embodiments may be combined with the features and characteristics of other embodiments. Such modifications and variations are intended to be included within the scope of this specification. As such, the claims may be amended to recite any elements, steps, limitations, features, and/or characteristics expressly or inherently described in, or otherwise expressly or inherently supported by, this specification. Further, Applicants reserve the right to amend the claims to affirmatively disclaim elements, steps, limitations, features, and/or characteristics that are present in the prior art regardless of whether such features are explicitly described herein. Therefore, any such amendments comply with the requirements of 35 U.S.C. § 112, first paragraph, and 35 U.S.C. § 132(a). The various embodiments disclosed and described in this specification can comprise, consist of, or consist essentially of the steps, limitations, features, and/or characteristics as variously described herein.

Any patent, publication, or other disclosure material identified herein is incorporated by reference into this specification in its entirety unless otherwise indicated, but only to the extent that the incorporated material does not conflict with existing definitions, statements, or other disclosure material expressly set forth in this specification. As such, and to the extent necessary, the express disclosure as set forth in this specification supersedes any conflicting material incorporated by reference herein. Any material, or portion thereof, that is said to be incorporated by reference into this specification, but which conflicts with existing definitions, statements, or other disclosure material set forth herein, is only incorporated to the extent that no conflict arises between that incorporated material and the existing disclosure material. Applicants reserve the right to amend this specification to expressly recite any subject matter, or portion thereof, incorporated by reference herein.

The grammatical articles "one", "a", "an", and "the", if and as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

Various embodiments disclosed and described in this specification are directed to a hold down mechanism for releasably holding a lining relative to a furnace. One non-limiting application described and illustrated herein is a hold down mechanism for releasably holding a refractory lining relative to an industrial, coreless induction furnace. However, it will be understood that the hold down mechanism may be used in any suitable furnace. The hold down mechanism can be used with a residential furnace, commercial furnace, and/or an industrial furnace, for example. Further, the hold down mechanism can be used with, for example, an electric arc furnace, reverberatory furnace, crucible furnace, cupola furnace, and/or induction furnace such as, for example, a coreless induction furnace and/or channel-type induction furnace.

Figure 2:
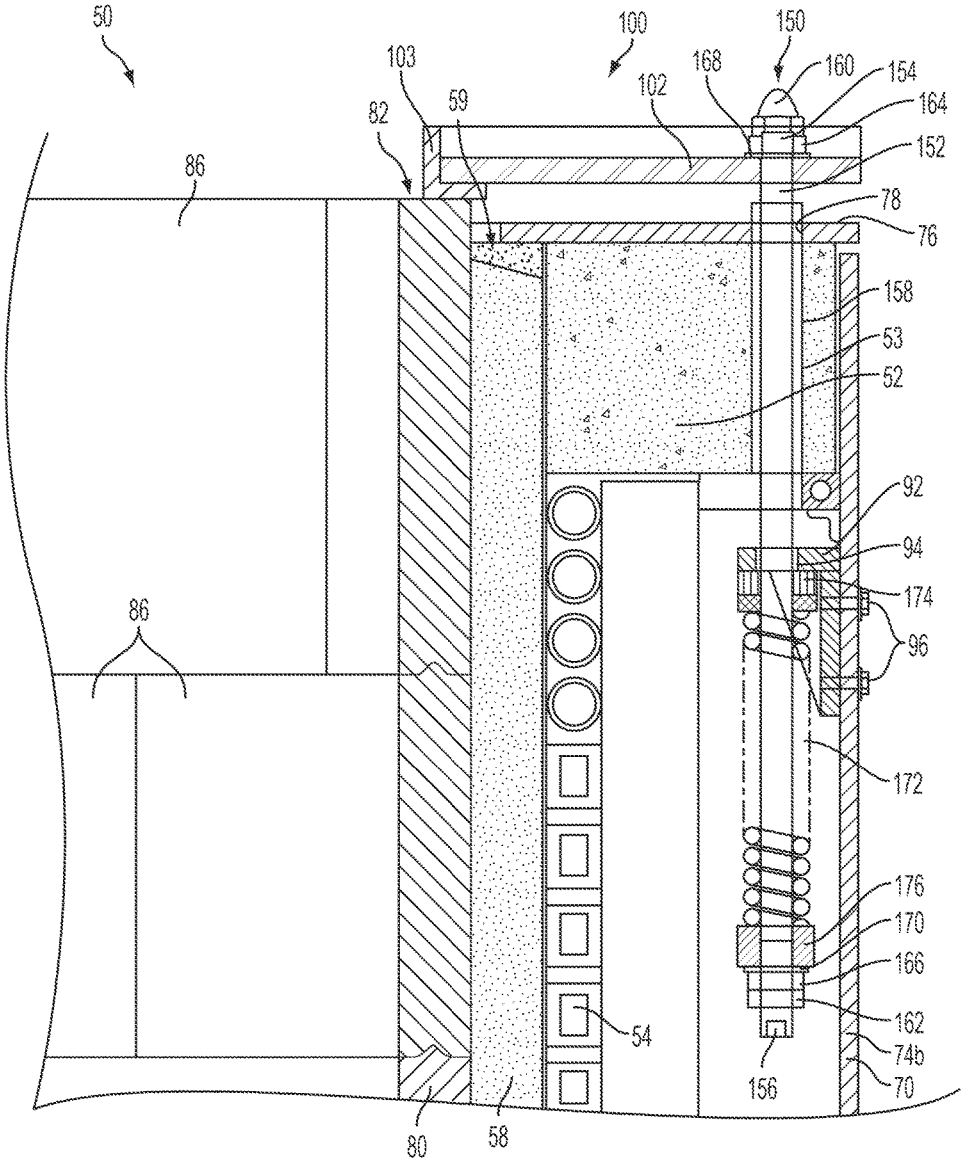
FIG. 2 is a detail, cross-sectional, elevational view of the furnace and the hold down mechanism of FIG. 1.

Referring to FIGS. 1 and 2, a coreless induction furnace 50 can comprise an induction coil 54 that is coiled within a frame 70 of the furnace 50. Further, a crucible 58 can be positioned within the frame 70 such that the coil 54 surrounds at least a portion of the crucible 58. The coil 54 can wrap or wind around a portion of the crucible 58, for example. In various embodiments, the crucible 58 can be configured to receive an alloy charge 90 such as, for example, a ferrous alloy charge. In other embodiments, the charge 90 can comprise a non-ferrous alloy. Electromagnetic induction in the coil 54 can generate a secondary current within the charge 90, as described in greater detail herein.

Figure 7:
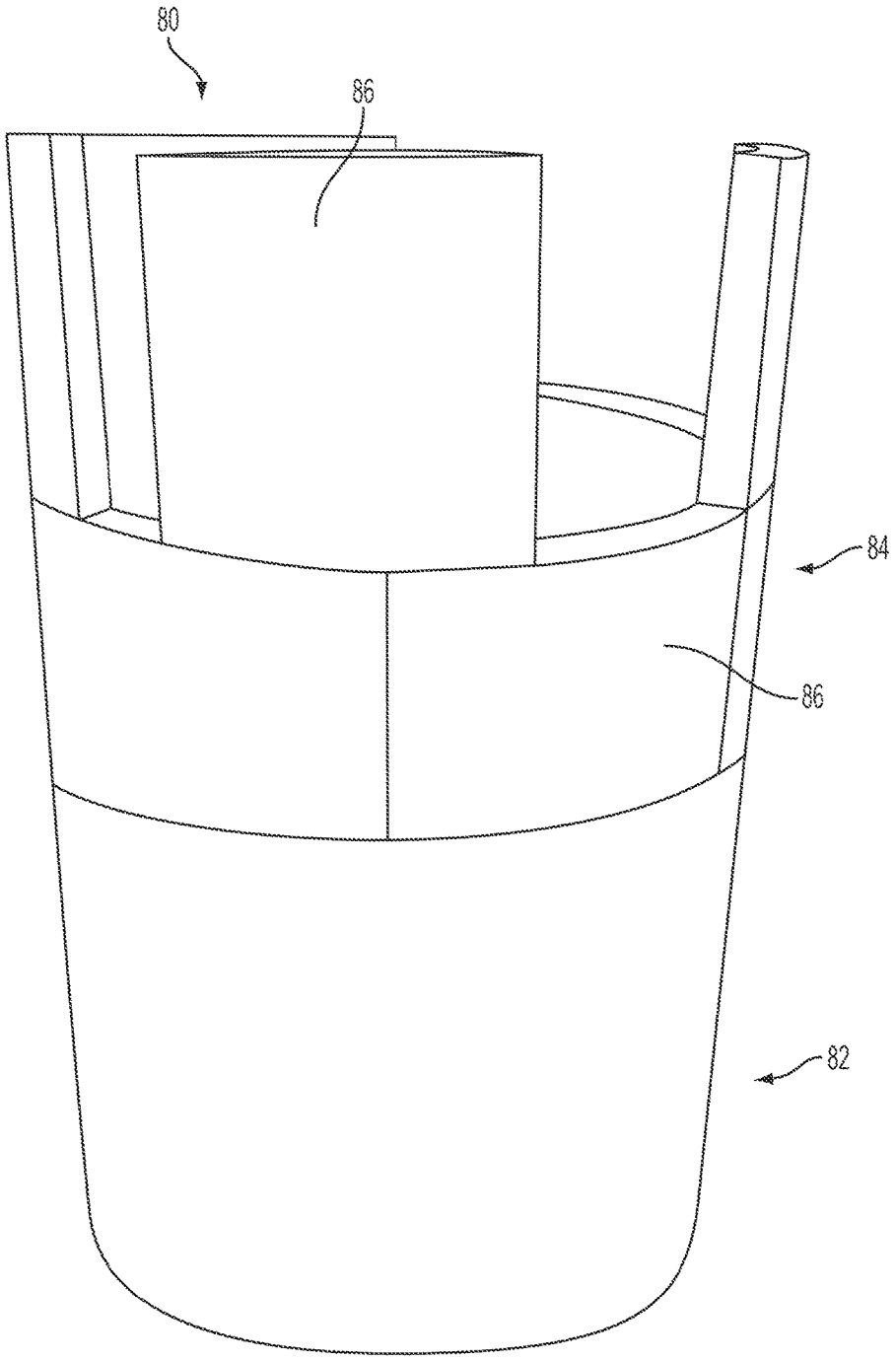
FIG. 7 is a perspective view of the refractory lining of FIG. 1.

A refractory lining 80 can also be positioned in the crucible 58. In various embodiments, the refractory lining 80 can form an interior layer of the crucible 58. The lining 80 can comprise a refractory material, such as, for example, silica ($SiO_2$), alumina ($Al_2O_3$), and/or magnesia (MgO). In some embodiments, the refractory lining 80 can comprise firebrick, clay, sand, and/or any other material having a sufficiently high melting point. In various embodiments, the lining 80 can be a rammed lining, bricked lining, or combination rammed-bricked lining. For example, referring to FIG. 7, the lining 80 can comprise a rammed portion 82 and a bricked portion 84. The rammed portion 82 can form a lower, bowl shape, for example. Further, the rammed portion 82 can comprise granular material, such as a silica ramming mix, that has been at least partially sintered and rammed with an electric vibrator until compacted. The bricked portion 84 can comprise at least one row of ceramic firebricks 86 that are pieced together to form a side wall of the lining 80. In various embodiments, the lining 80 can comprise two rows of firebricks 86 above the rammed portion 82. The firebricks 86 can comprise a curvature such that the rows of firebricks 86 forms a cylindrical wall that substantially matches the inner wall of the crucible 58, for example.

Figure 6:
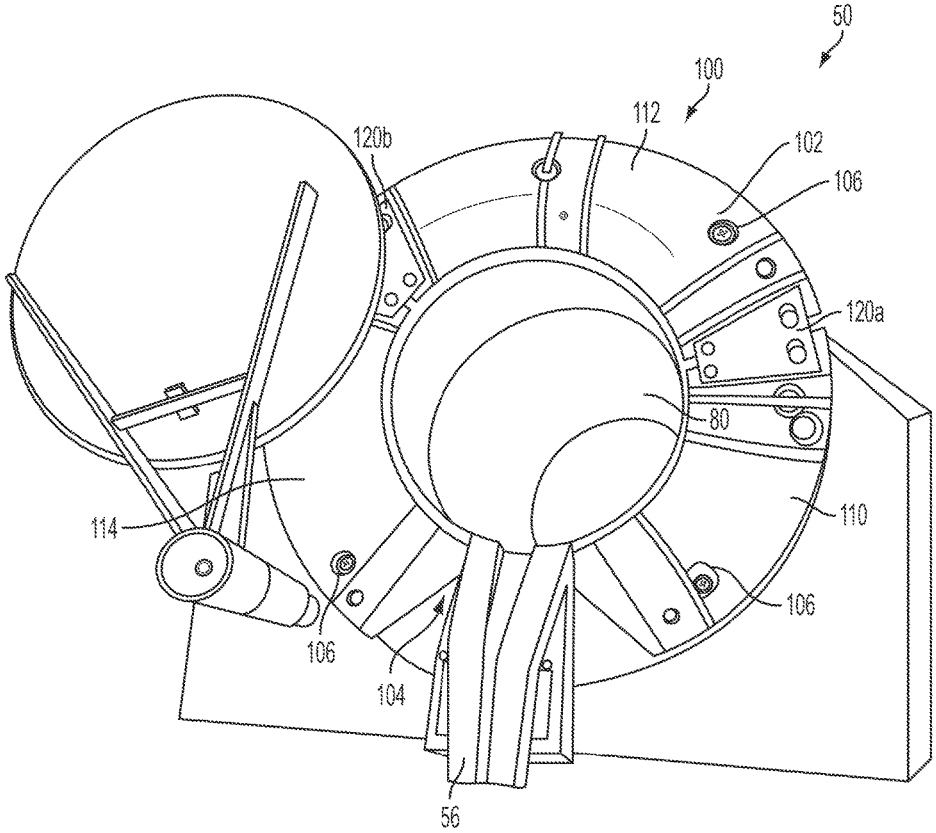
FIG. 6 is a perspective view of the furnace and the hold down mechanism of FIG. 1.

In various embodiments, referring primarily to FIGS. 1 and 6, the furnace 50 can be tilted to fully or partially empty the contents therefrom. For example, once the furnace 50 has melted the charge 90, the crucible 58 of the furnace 50 can be tilted to pour the molten charge 90 from the crucible 58 to a holding channel, a transfer ladle, a treatment ladle, and/or a pouring furnace, for example. The furnace 50 can also comprise a spout 56 that extends from the lining 80 and/or from the crucible 58. When the crucible 58 is tipped, the molten charge 90 can pour from the crucible 58 along the spout 56. Referring again to FIG. 1, the frame 70 of the furnace 50 can have a base 72, sides 74*a*, 74*b*, and a top 76. In various embodiments, the furnace can be positioned on or near a lift assembly 60. The lift assembly 60 can operably tilt the base 72 of the frame 70 such that the crucible 58 tips, for example. In some embodiments, the lift assembly 60 can comprise a ledge 62, an arm 64, and a pivot 66. In various embodiments, the ledge 62 can be positioned under the furnace 50 such that the ledge 62 supports the crucible 30 of the furnace 50. The ledge 62 can be positioned below the base 72 of the frame 70, for example. Further, in various embodiments, the arm 64 can connect the ledge 62 to the pivot 66. In various embodiments, a hydraulic mechanism, a pulley, a lever system or a combination thereof can tilt the crucible 58 of the furnace 50 to pour the molten charge 90 therefrom. When the crucible 58 is tilted, the hold down mechanism 100 can hold the refractory lining 80 relative to the crucible 58 and/or the furnace frame 70, as described in greater detail herein.

Referring primarily to FIG. 2, the hold down mechanism 100 can be secured to the frame 70 of the furnace 50 by a fastener assembly 150. In various embodiments, a portion of the fastener assembly 150 can extend through an aperture 106 in a composite plate 102 of the hold down mechanism 100, an aperture 78 in the top surface 76 of the frame 70, and/or an aperture 94 in a bracket 92 on the frame 70. In some embodiments, the bracket 92 can be secured to the side wall 74*a* of the frame 70 by at least one fastener such as, for example, by two screws 96. In various embodiments, a shaft 152 of the fastener assembly 150 can extend through the aperture 106 in the hold down mechanism 100, the aperture 78 in the top surface 76 of the frame 70, and the aperture 94 in the bracket 92. Between the top surface 76 of the frame 70 and the bracket 92, the shaft 152 can extend through a bore 53 in a body portion 52 of the furnace 50, for example. The shaft 152 of the fastener assembly 150 can also extend through a shaft collar 158 in the body portion 52 of the furnace 50, for example. In various embodiments, the shaft 152 can comprise a first distal end 154 and a second distal end 156.

In various embodiments, referring still to FIG. 2, the fastener assembly 150 can comprise an upper nut 160 and a lower nut 162. The upper nut 160 can be positioned at or near the first distal end 154 of the shaft 152, for example. Further, the lower nut 162 can be positioned at or near the second distal end 156 of the shaft 152, for example. The upper and/or lower nuts 160, 162 can be acorn nuts, for example. In some embodiments, the upper nut 160 can secure the first distal end 154 of the shaft 152 relative to an external side of the hold down mechanism 100. In some embodiments, the lower nut 162 can secure the second distal end 156 of the shaft 152 relative to an internal side of the frame 70. For example, the lower nut 162 can secure the second distal end 156 of the shaft 152 relative to the bracket 92 within the frame 70. The fastener assembly 150 can also comprise an upper jam nut 164, and/or upper washer 168 positioned at or near the first distal end 154 of the shaft 152, for example. Furthermore, a lower jam nut 166 and/or lower washer 170 can be positioned at or near the second distal end 156 of the shaft 152, for example.

In various embodiments, the fastener assembly 150 can also comprise a coil spring 172 disposed around at least a portion of the shaft 152. In some embodiments, the coil spring 172 can be deformed when the fastener assembly 150 secures the hold down mechanism 100 to the furnace 50. Referring still to FIG. 2, the coil spring 172 can be positioned between the lower nut 162 and the bracket 92, for example. In some embodiments, spacers 174, 176 can also be positioned between the lower nut 162 and the bracket 92. The coil spring 172 can be positioned between the spacers 174, 176, for example. When the fastener assembly or assemblies 150 secure the hold down mechanism 100 to the furnace 50, the coil spring 172 can be deformed from an initial configuration to a deformed configuration. The deformed coil spring 172 can exert a restoring force on elements between the proximal end 154 and the distal end 156 of the shaft 152 as the deformed coil spring 172 seeks to return to its initial, undeformed configuration. For example, the coil spring 172 can exert a restoring force on the spacers 174, 176.

In various embodiments, the coil spring 172 can be a compression spring. In such embodiments, when the coil spring 172 is deformed from the initial position to the deformed position, the coil spring 172 can generate a restoring force on the bracket 92 via the upper spacer 174 and on the lower nut 162 via the lower spacer 170. The restoring force may be a substantially axial pushing force, for example. When the lower nut 162 is fixedly attached to the shaft 122 of the fastener assembly 150, the restoring force generated by the coil spring 172 can help to secure the hold down mechanism 100 to the furnace 50. In other embodiments, the coil spring 172 can be a tension spring. In such embodiments, the restoring force generated by the coil spring can be a substantially axial pulling force, for example, and the coil spring 172 can facilitate the removal of the hold down mechanism 100 from the furnace 50, for example. In various embodiments, a single fastener assembly 150 can secure the hold down mechanism 100 to the furnace 50. In other embodiments, multiple fastener assemblies 150 can engage the hold down mechanism 100 and the furnace 50. A plurality of fastener assemblies 150 can be positioned around the perimeter of the top surface 76 of the frame 70, for example.

In various embodiments, still referring primarily to FIG. 2, the lining 80 can comprise a rim 82. The rim 82 can extend beyond the top edge 59 of the crucible 58 and/or the top surface 76 of the frame 70, for example. In other embodiments, the rim 82 can extend flush with or below the top edge 59 of the crucible 58 and/or the top surface 76 of the frame 70. When the hold down mechanism 100 is secured to the furnace 50, such as by the fastener assembly 150 described in greater herein, a portion of the hold down mechanism 100 can overlap or overlie a portion of the rim 82. As described in greater detail herein, the hold down mechanism 100 can comprise a composite plate 102 and/or a lip 103. The lip can run along at least a portion of the inner perimeter of the composite plate 102, for example. In various embodiments, the overlapping portion of the hold down mechanism 100 can comprise a portion of the composite plate 102 and/or the lip 103. The overlapping portion of the hold down mechanism 100 can help to secure the lining 80 to the crucible 58 of the furnace 50. In other words, when the crucible 58 is tilted, the overlapping portion of the hold down mechanism 100 can prevent the lining 80 from sliding out of the crucible 58. In various embodiments, a portion of the hold down mechanism 100 can abut the rim 82 of the lining 80 when the hold down mechanism 100 is secured to the furnace. The abutting portion of the hold down mechanism 100 can comprise a portion of the composite plate 102 and/or the lip 103, for example. Referring to FIG. 2, the lip 103 can abut the rim 82 of the lining 80, for example. Consequently, the lip 103 and/or other abutting portion of the hold down mechanism 100 can prevent the lining 80 from sliding or moving relative to the crucible 58.

Figure 3:
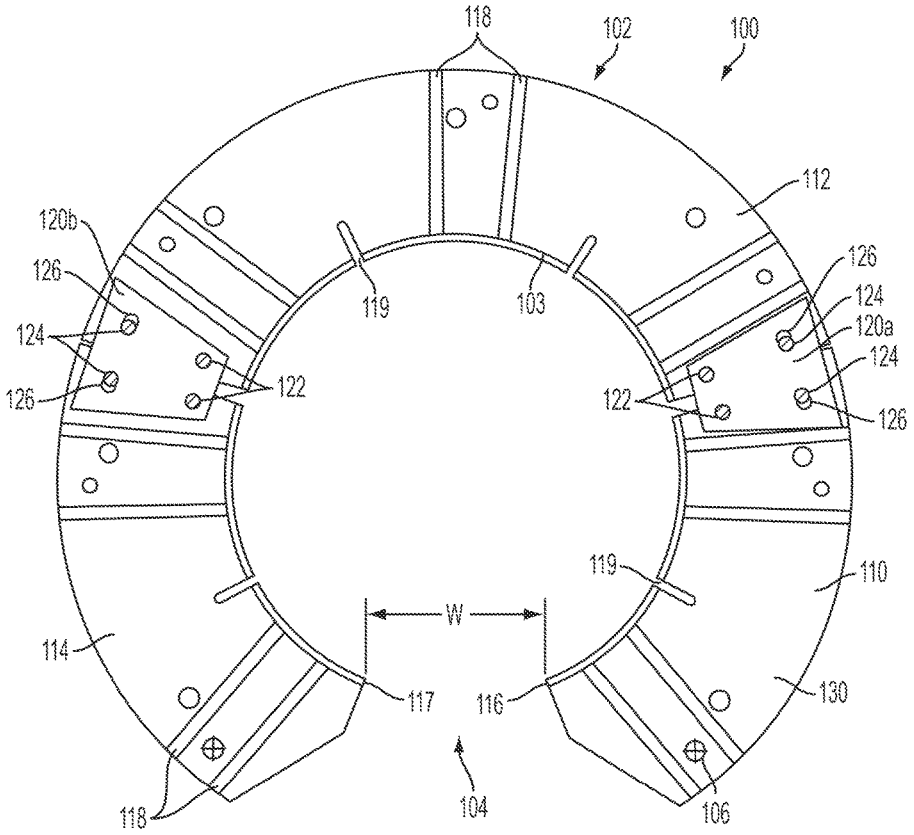
FIG. 3 is a plan view of the hold down mechanism of FIG. 1 in a contracted configuration.
Figure 4:
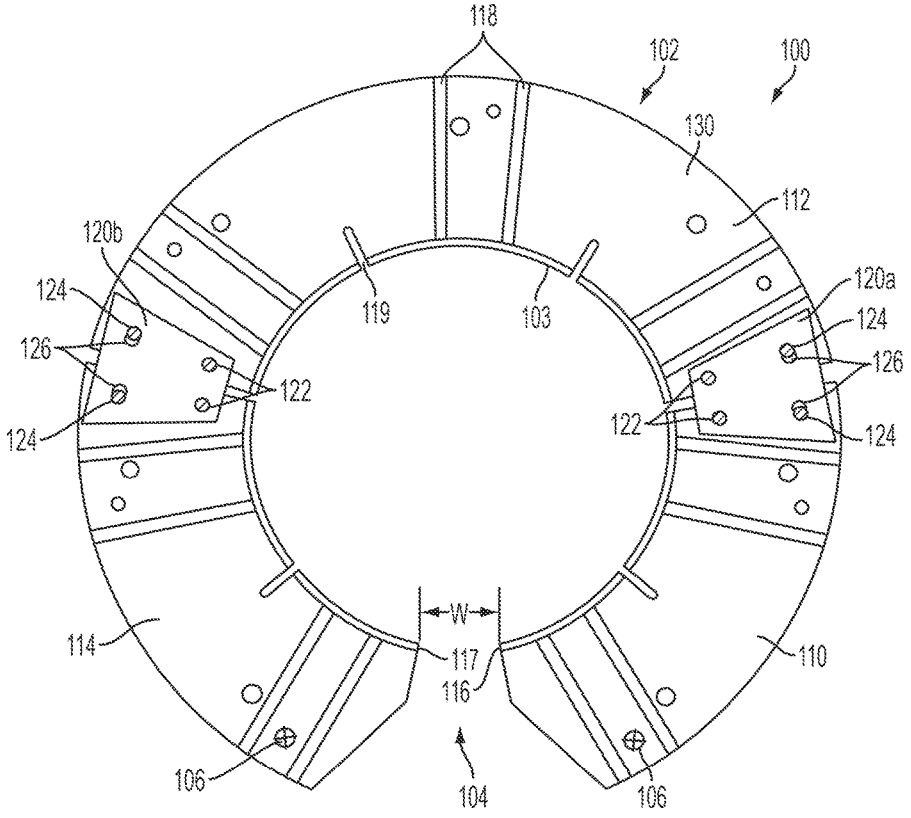
FIG. 4 is a plan view of the hold down mechanism of FIG. 1 in an expanded configuration.
Figure 5:
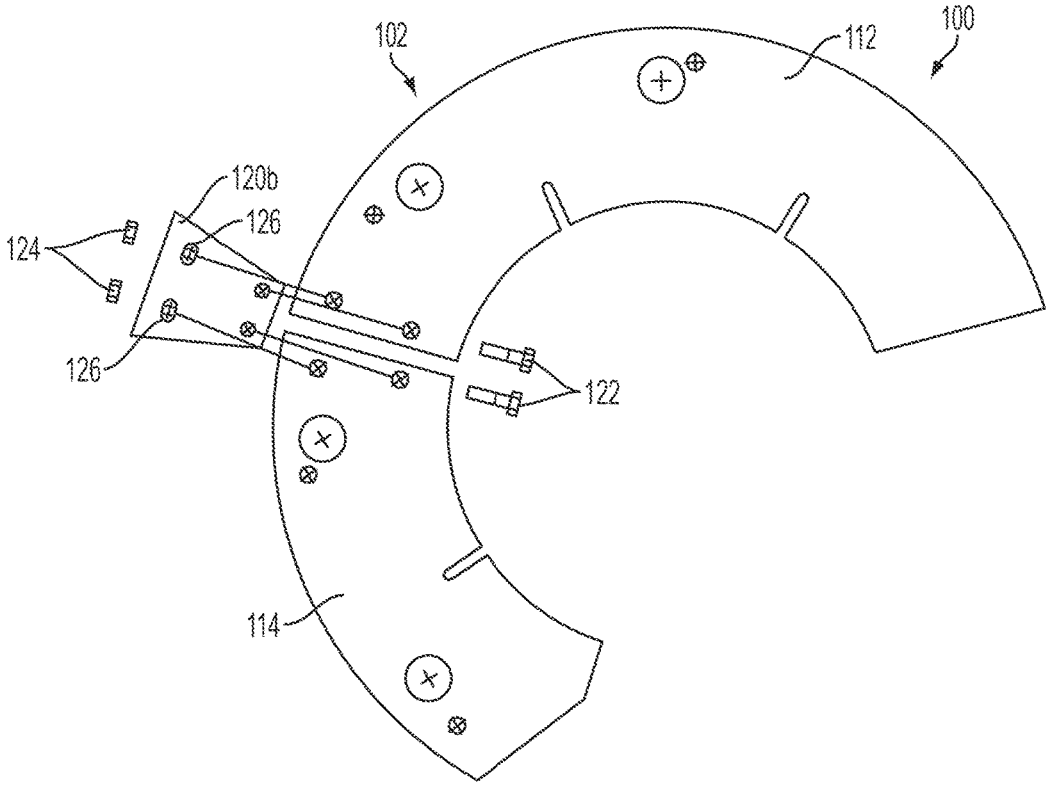
FIG. 5 is a partial exploded view of the hold down mechanism of FIG. 1.

Referring now to FIGS. 3-5 the hold down mechanism 100 can comprise the composite plate 102 and a gap 104. In some embodiments, the hold down mechanism 100 can also comprise the lip 103 around at least a portion of the inner perimeter of the composite plate 102. In various embodiments, the composite plate 102 can comprise a plurality of plate segments. The composite plate 102 can have a first plate segment 110 and a second plate segment 112, for example. In other embodiments, as illustrated in FIGS. 3 and 4, for example, the composite plate 102 can have a third plate segment 114, as well. In various other embodiments, the composite plate 102 can have four or more plate segments. In various embodiments, the plate segments of the composite plate 102 can comprise the same or substantially the same geometry. In other embodiments, the plate segments of the composite plate 102 can comprise different geometries. In various embodiments, at least one plate segment 110, 112, 114 can comprise a top surface 130. The top surface 130 can comprise a substantially flat surface and/or a rounded surface, for example. In some embodiments, each plate segment 110, 112, 114 can comprise a rounded top surface 130. As described in greater detail herein, at least one plate segment of the composite plate 102 can be structured to articulate relative to at least one other plate segment of the composite plate 102.

Referring still to FIGS. 3-5, the plate segments 110, 112, 114 can be arranged such that they form an arc. The arc can comprise curved portions and/or corners, for example. In various embodiments, when the hold down mechanism 100 is secured to the furnace, as described in greater detail herein, the arc can correspond to the geometry of the lining 80 and/or the crucible 58. In some embodiments, the lip 103 of the hold down mechanism 100 can form a portion of the arc. In such embodiments, the arced lip 103 can corresponds to the inner and/or outer perimeter of the lining 80. The arced lip 103, for example, can curve around the top surface 76 of the frame 70 such that the lip 103 overlaps the lining 80. In some embodiments, at least one plate segment 110, 112, 114 can comprise a curvature. In various embodiments, the plate segments 110, 112, 114 can each comprise a curvature. The curvature of the plate segments 110, 112, 114 can form the arc, for example. In various embodiments, at least one plate segment 110, 112, 114 can comprise a substantially straight shape rather than a curvature. In some embodiments, the plate segments 110, 112, 114 may each comprise a substantially straight shape such that the plate segments must be angularly offset from each other to form the arc. In various embodiments, the plate segments 110, 112, 114 can comprise a polygonal shape such as, for example, a square, a rectangle, an isosceles trapezoid, a non-isosceles trapezoid and/or a combination thereof. In various embodiments, the curvature of each plate segment 110, 112, 114 can be substantially the same. In other embodiments, the curvature of at least one plate segment 110 can be different than the curvature of at least one other plate segment 110. For example, the first and second plate segments 110, 112 can comprise substantially the same curvature and the third plate segment 114 can comprise a different curvature. In still other embodiments, the curvature of each plate segment 110, 112, 114 can differ from the others.

Further to the description above, the plate segments 110, 112, 114 of the composite plate 102 can be structured to articulate. In various embodiments, the first plate segment 110 can be structured to articulate relative to the second plate segment 112. Further, the second plate segment 112 can be structured to articulate relative to the third plate segment 114. In some embodiments, each plate segment of the composite plate 102 can be structured to articulate relative to the other plate segments. As the at least one plate segments articulates or pivots, the composite plate 102 can move from a first position to a second position. As described in greater detail herein, the plate segments can articulate in response to temperature or other thermal conditions thereof, for example. The first position can correspond with a contracted position (FIG. 3), for example, and the second position can correspond with an expanded position (FIG. 4), for example. As the composite plate 102 moves from the first position to the second position, the shape of the arc can also adjust.

The hold down mechanism 100 can also comprise an articulation plate, such as articulation plates **120*a* and/or 120*b*, for example. In various embodiments, the hold down mechanism 100 can have one articulation plate 120*a*. The first articulation plate 120*a* can be positioned between adjacent plate segments such as, for example, between the first plate segment 110 and the second plate segment 112**.

Further, the first articulation plate 120*a* can overlap a portion of the first and/or second plate segments 110, 112. Additionally or alternatively, a portion of the first articulation plate 120*a* can be positioned above, below, and/or adjacent to the first and/or second plate segments 110, 112, for example. In various embodiments, as illustrated in FIGS. 3 and 4, for example, the hold down mechanism 100 can have two articulation plates 120*a*, 120*b*. The second articulation plate 120*b* can be positioned between the second plate segment 112 and the third plate segment 114, for example. Further, the second articulation plate 120*b* can overlap a portion of the second and/or third plate segments 112, 114, for example. Additionally or alternatively, a portion of the second articulation plate 120*b* can be positioned above, below, and/or adjacent to the second and/or third plate segments 112, 114, for example. Referring still to FIGS. 3 and 4, the first articulation plate 120*a* can partially overlap a portion of the first plate segment 110 and a portion of the second plate segment 112, for example, and the second articulation plate 120*b* can partially overlap a portion of the second plate segment 112 and a portion of the third plate segment 114, for example. In various embodiments, the articulation plates 120*a*, 120*b* of the hold down mechanism 100 can comprise the same or substantially the same geometry. In other embodiments, the articulation plates 120*a*, 120*b* of the hold down mechanism 100 can comprise different geometries. In some embodiments, the hold down mechanism 100 can comprise three of more articulation plates. In various embodiments, the hold down mechanism can comprise one fewer articulation plate than plate segments, for example. Furthermore, in such embodiments, an articulation plate can be positioned between adjacent plate segments of the composite plate 102, for example, but may not be positioned between the plate segments that are separated by the gap 104, for example.

In various embodiments, the articulation plates 120*a*, 120*b* can facilitate articulation of the plate segments 110, 112, 114. Referring still to FIGS. 3 and 4, the first articulation plate 120*a* can connect the first plate segment 110 and the second plate segment 112, for example. In some embodiments, the first articulation plate 120*a* can overlap a portion of the first plate segment 110, a portion of the second plate segment 112, and a space between adjacent edges of the first and second plate segments 110, 112. As the first and/or second plate segments 110, 112 articulate, the space between the segments 110, 112 can accommodate the movement thereof. Further, as described in greater detail herein, the gap 104 can adjust as the plate segments 110, 112 move. In various embodiments, the second articulation plate 120*b* can similarly connect the second plate segment 112 and the third plate segment 114, for example. In such embodiments, the second articulation plate 120*b* can overlap a portion of the second plate segment 112, a portion of the third plate segment 114, and a space between adjacent edges of the second and third plate segments 112, 114. As the second and/or third plate segments 112, 114 articulate, the space between the segments 112, 114 can accommodate the movement thereof. Further, as described in greater detail herein, the gap 104 can adjust as the plate segments 112, 114 move.

Referring to FIGS. 3-5, the hold down mechanism 100 can further comprise at least one pivot 122. In various embodiments, at least one pivot 122 can engage the first plate segment 110 and the adjacent first articulation plate 120*a* such that the first plate segment 110 is coupled to the first articulation plate 120*a*. In some embodiments, pivots 122 can couple the first and second plate segments 110, 112 to the first articulation plate 120*a* positioned therebetween. In some embodiments, the third plate segment 114 can be similarly coupled to the second plate segment 112 via pivots 122 and the second articulation plate 120*b*. In other embodiments, a pivot 122 can directly connect the first plate segment 110 to the second plate segment 112 such that the first plate segment 110 is pivotable relative to the second plate segment 112. In some embodiments, another pivot 122 can directly connect the second plate segment 112 and the third plate segment 114 such that the second plate segment 112 is pivotable relative to the third plate segment 114. In other words, in various embodiments, an articulation plate may not be positioned between some or all adjacent plate segments.

In various embodiments, the hold down mechanism 100 can comprise at least one slot 126. The slot 126 can facilitate articulation of the plate segments 110, 112, 114 and/or of the articulation plates 120*a*, 120*b*, for example. In some embodiments, the articulation plates 120*a*, 120*b* can comprise at least one slot 126. A pin 124 can engage the first plate segment 110 and the slot 126 in the first articulation plate 120*a*. As the first plate segment 110 pivots relative to the first articulation plate 120*a*, for example, at the pivot 122, the pin 124 can slide or move in the slot 126 of the articulation plate 120*a*. In various embodiments, the first articulation plate 120*a* can comprise another slot 126 and another pin 124 can slide or move in the slot 126 as the second plate segment 112 pivots at another pivot 122. In various embodiments, the third plate segment 114 can be coupled to the second plate segment 112 via the second articulation plate 120*b*, which can also comprise at least one slot 126. In some embodiments, the first plate segment 110, the second plate segment 112, and/or the third plate segment 114 can comprise at least one slot 126.

Referring primarily to FIGS. 3 and 4, the composite plate 102 of the hold down mechanism 100 can comprise a first end 116 and a second end 117. In various embodiments, the first and second ends 116, 117 can be positioned on the interior perimeter of the hold down mechanism, such as, for example, on the lip 103 of the composite plate 102. Furthermore, the gap 104 can be positioned between the first end 116 and the second end 117 and can comprise a width W. Referring to FIG. 3, the width W can vary as at least one of the plate segments 110, 112 and/or 114 articulate, for example. Further, in various embodiments, the space between adjacent plate segments can also vary as at least one plate segment 110, 112, 114 articulates. As described in greater detail herein, the plate segments 110, 112, 114 can articulate in response to a temperature or other thermal condition of the hold down mechanism 100.

As described in greater detail herein, at least one plate segment of the composite plate 102 can be structured to articulate relative to at least one other plate segment of the composite plate 102. As at least one plate segment articulates or pivots, the composite plate 102 can move from a first position to a second position, for example. The first position can correspond to a contracted position (FIG. 3), for example, and the second position can correspond to an expanded position (FIG. 4), for example. Furthermore, the width W of the gap 104 can vary as the composite plate 102 moves from the first position to the second position. In various embodiments, a plate segment of the composite plate 102 can articulate in response to a thermal condition of the hold down mechanism 100. For example, thermal expansion of a portion of the hold down mechanism 100 can cause a plate segment to articulate.

Referring to FIG. 3, for example, the composite plate 102 can be in a first, contracted position, wherein the plate segments are in a first configuration relative to each other, and wherein the width W of the gap 104 comprises a larger dimension. Referring now to FIG. 4, for example, the composite plate 102 can move to a second, expanded position, wherein the plate segments are in a second configuration relative to each other, and wherein the width W of the gap 104 comprises a smaller dimension. Thermal expansion of at least one plate segment can cause the plate segment(s) to articulate such that the composite plate 102 moves to the second, expanded position. In other words, as at least one plate segment absorbs heat and expands, the plate segments 110, 112, 114 of the composite plate 102 can shift to accommodate the expanded plate segment. The spaces between adjacent plates, the variable gap 104 and/or the pivots 122 allow the plate segments 110, 112, 114 to shift or articulate. The gap 104 can comprise a smaller dimension to absorb the thermal expansion of the at least one plate segment when the composite plate moves to the second, expanded position. The thermal expansion of the composite plate 102 can be uniform. Alternatively, the thermal expansion of the composite plate 102 can be non-uniform. In such embodiments, at least one plate segment and/or articulation plate can expand more or less than at least one other plate segment and/or articulation plate, for example. The thermal expansion can be non-uniform when portions of the composite plate 102 are subjected to different temperatures during operation of the furnace 50, for example.

The thermal expansion of the composite plate 102 can depend on the material thereof. In various embodiments, the composite plate 102 can comprise a ferrous alloy such as, for example, mild steel, carbon steel, cast iron, stainless steel, and/or wrought iron. Certain grades of stainless steel have a linear thermal expansion of approximately $9.6\times10^{-6}$ inches/° F., for example. Accordingly, when the composite plate 102 is comprised of certain stainless steel grades and is heated to an operating temperature of approximately 3000° F., for example, the composite plate 102 can expand approximately $2.9\times10^{-2}$ inch/inch, for example. In various embodiments, the composite plate 102 for the hold down mechanism 100 can comprise an inner circumference of approximately 95 inches, for example. Such a stainless steel composite plate 102 can allow approximately 2.74 inches of expansion around the perimeter, for example.

In various embodiments, at least one plate segment of the composite plate 102 can be fastened to the body portion 52 and/or the frame 70 of the furnace 50. In some embodiments, two plate segments of the composite plate 102 can be fastened to the furnace 50. The first plate segment 110 and the third plate segment 114 can be fastened to the furnace 50, for example, and the second plate segment 112 can be coupled to the first plate segment 110 and the third plate segment 114, for example. In other embodiments, each plate segment can be fastened to the furnace 50. The first, second and third plate segments 110, 112, 114 can be fastened to the furnace, for example. A plate segment can be fastened to the furnace 50 via a fastener assembly 150, as described in greater detail herein. In various embodiments, where a plate segment is secured to the furnace 50, the plate segment can be fixed relative to the furnace 50. In other words, the plate segment may be held stationary relative to the furnace 50 at and/or around the fastener assembly 150.

In various embodiments, the first plate segment 110 of the composite plate 102 can be secured to the furnace 50 by a single fastener assembly 150. In such embodiments, the first plate segment 110 can remain fixed to the furnace at the single fastener assembly 150. Further, when the first plate segment 110 is subjected to a high temperature, the first plate segment 110 can shift and/or expand, as described in greater detail herein. To accommodate the shifting and/or expansion, the first plate segment 110 can articulate relative to the other plate segments 112, 114 and/or the articulation plates 120*a*, as also described in greater detail herein. Despite articulation of the first plate segment 110, it can remain fixed to the furnace 50 where the fastener assembly 150 engages the furnace 50 and the first plate segment 110. In other words, when the composite plate 102 moves from the first, contracted position to the second, expanded position, the first plate segment 110 can articulate, however, the first plate segment remains stationary relative to the furnace 50 at and/or around the fastener assembly 150 engagement. Where the first plate segment 110 is secured to the furnace by only one fastener assembly 150, buckling or warping of the first plate segment 110 can be prevented or limited. Rather than buckling at a high temperature, the first plate segment 110 can pivot to accommodate the thermal expansion. In some embodiments, the first plate segment 110 can pivot and buckle only slightly in response to thermal expansion thereof. The other plate segments, for example plate segments 112, 114, can also articulate to accommodate the thermal expansion of a portion of the composite plate 102.

In various embodiments, the first plate segment 110 can be secured to the furnace 50 by two fastener assemblies 150. In such embodiments, the intermediate portion of the first plate segment 110, i.e., the portion that is positioned between the two fasteners assemblies 150, can be restrained therebetween. Restriction of the intermediate portion can cause buckling thereof when the plate segment 110 is subjected to higher temperatures such that the plate segment 110 undergoes thermal expansion. In various embodiments, at least one plate segment of the composite plate 102 can not be fastened to the furnace 50. In such embodiments, the non-fastened plate segments can be secured to another plate segment; the non-fastened plate segments can float relative to the furnace 50, for example.

In various embodiments, the composite plate 102 of the hold down mechanism 100 can comprise a reinforcing scheme or schemes. In various embodiments, the reinforcing scheme can comprise arms, ribs and/or shoulders, for example. Referring to FIGS. 3 and 4, for example, at least one plate segment 110, 112, 114 of the composite plate 102 can comprise a support rib 118. In various embodiments, each plate segment 110, 112, 114 can comprise a plurality of support ribs 118. Furthermore, the composite plate 102 can comprise a groove 119. In various embodiments, at least one plate segment 110, 112, 114 of the composite plate 102 can comprise a groove 119. In various embodiments, each plate segment 110, 112, 114 can comprise a plurality of grooves 119.

In various embodiments, the hold down mechanism 100 can be reused when the furnace 50 is relined. For example, a method of relining the furnace 50 can comprise the steps of disengaging the hold down mechanism 100 from the furnace 50. The hold down mechanism 100 can be disengaged from the furnace 50 by loosening the fastener assembly or assemblies 150 that engage the frame 70 of the furnace 50, for example, and engage the composite plate 102 of the hold down mechanism 100, for example. Referring primarily to FIG. 2, the upper nut 160, upper jam nut 164 and/or upper washer 168 can be removed from the first distal end 154 of the shaft 152 of the fastener assembly 150, for example. In some embodiments, the shaft 152 can be withdrawn from the bore 53 through the body portion 52 of the furnace 50. In other embodiments, the shaft 152 can remain engaged with the furnace 50. For example, the shaft collar 158 can hold the shaft 152 of the fastener assembly 150 relative to the body portion 52 and/or the frame 70 of the furnace 50. Upon removal of the nuts 160, 164 and/or washers 168 at the first distal end 154 of the shaft 152, for example, the composite plate 102 of the hold down mechanism 100 can be disengaged from the furnace 50. The lining 80 can then be removed from the crucible 58 of the furnace 50 by any means known in the art. A replacement lining 88 can then be positioned in the furnace 50. In various embodiments, the replacement lining 88 can be positioned against the inner wall of the crucible 58, for example.

In various embodiments, after positioning the replacement lining 88 in the furnace 50, the hold down mechanism 100 can be reengaged with the furnace 50. In other words, the hold down mechanism 100 can be reinstalled and reused when the furnace 50 is relined with the replacement lining 88. In some embodiments, the composite plate 102 of the hold down mechanism 100 can be secured to the frame 70 of the furnace 50 by the fastener assembly or assemblies 150. For example, the upper nut 160, upper jam nut 164 and/or upper washer 168 can be reengaged with the first distal end 152 of the shaft 152. Upon tightening the nuts 160, 164 to the shaft 152, for example, the composite plate 102 can be secured to the furnace 50. In some embodiments, the composite plate 102 can be bolted to the furnace 50. Further, in various embodiments, the spout 56 of the furnace 50 can be positioned within the gap 104 of the hold down mechanism 100 when the composite plate 102 of the hold down mechanism 100 is secured to the furnace 50.

In some embodiments, during operation of the furnace 50, at least one plate segment of the composite plate 102 can become worn out or otherwise damaged. Further, when the hold down mechanism 100 is reinstalled and reused, a plate segment of the composite plate 102 can be replaced with a replacement plate segment, for example. In various embodiments, each damaged plate segment can be replaced with a replacement plate segment, for example. In other words, the hold down mechanism 100 can reinstalled and reused with previously-used plate segment(s), as well as with replacement plate segment(s), for example. The replacement plate segment(s) can be new plate segment(s), reworked plate segment(s), or a combination thereof, for example.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth herein. Such embodiments may be obtained, for example, by combining, modifying, or reorganizing any of the disclosed steps, components, elements, features, aspects, characteristics, limitations, and the like, of the various non-limiting embodiments described in this specification. In this manner, Applicants reserve the right to amend the claims during prosecution to add features as variously described in this specification, and such amendments comply with the requirements of 35 U.S.C. § 112, first paragraph, and 35 U.S.C. § 132(a).

We claim:

1. A method of relining a furnace, the method comprising:

disengaging a hold down plate from the furnace, wherein the hold down plate is configured to adjust in response to a thermal condition during active operation of the furnace, thereby inhibiting warping of the hold down plate;

removing a first refractory lining from the furnace;

disposing a second refractory lining in the furnace; and reengaging the hold down plate with the furnace to releasably secure the second lining to the crucible, wherein the hold down plate comprises:

a composite plate comprising a plurality of segments, wherein a first segment is structured to articulate relative to a second segment during the active operation of the furnace; and a variable gap structured to adjust in response to thermal expansion or contraction of at least one segment of the plurality of segments, wherein the articulation comprises moving the composite plate from a first position to a second position.

2. The method of claim 1, wherein reengaging the hold down plate comprises fastening the hold down plate to the furnace.

3. The method of claim 1, wherein reengaging the hold down plate comprises bolting the second segment to the furnace, and wherein the first segment is configured to float relative to the furnace.

4. The method of claim 1, further comprising:

reusing at least one segment of the composite plate when the hold down plate is reengaged with the furnace; and replacing at least one segment of the composite plate with a replacement segment before reengaging the hold down plate with the furnace.

5. The method of claim 1, wherein the hold down plate comprises a pin-in-slot connection intermediate the first segment and the second segment of the composite plate.

6. The method of claim 1, wherein the composite plate further comprises a pivot joint intermediate the first segment and the second segment.

7. The method of claim 1, wherein the furnace comprises a spout, and wherein the reengaging step further comprises positioning the spout in the variable gap of the hold down plate.

8. The method of claim 1, wherein the hold down plate comprises an arced shape.

9. A method comprising:

heating a furnace during a plurality of melting operations, wherein the furnace comprises a refractory lining positioned at least partially within the furnace and a hold down plate configured to hold the refractory lining relative to the furnace, wherein the hold-down plate comprises a gap defining a width; and permitting the width of the gap to vary in response to a thermal condition of the hold down plate during the melting operations, wherein permitting the width of the gap to vary comprises permitting articulation of at least a portion of the hold down plate, thereby inhibiting deformation of the hold down plate during the melting operations.

10. The method of claim 9, further comprising:

replacing at least a portion of the refractory lining with a replacement refractory lining; and reinstalling the hold down plate to retain the replacement refractory to the furnace.

11. A method comprising:

heating a furnace during a plurality of melting operations, wherein the furnace comprises a refractory lining positioned at least partially within the furnace and a hold down plate configured to hold the refractory lining relative to the furnace, wherein the hold-down plate comprises a gap defining a width; and permitting the width of the gap to vary in response to a thermal condition of the hold down plate during the melting operations, wherein the hold down plate comprises:

a plurality of segments; and a pivot joint intermediate two adjacent segments.

12. The method of claim 11, further comprising replacing at least one segment with a replacement segment.

13. The method of claim 11, wherein at least one segment is fastened to the furnace and at least one other segment is configured to float relative to the furnace during the melting operations.

14. The method of claim 11, wherein the hold down plate further comprises a pin-in-slot connection intermediate two adjacent segments.

15. The method of claim 9, wherein the hold down plate comprises an arced shape.

* * * * *